US007010871B2

(12) United States Patent
Sussmann

(10) Patent No.: US 7,010,871 B2
(45) Date of Patent: Mar. 14, 2006

(54) OUTSOLE FOR SPORTS SHOES

(75) Inventor: Reinhold Sussmann, Scheinfeld (DE)

(73) Assignee: PUMA Aktiengesellschaft Rudolf Dassler Sport, Herzogenaurach (DE)

( * ) Notice: Subject to any disclaimer, the term of this patent is extended or adjusted under 35 U.S.C. 154(b) by 112 days.

(21) Appl. No.: 10/479,463

(22) PCT Filed: Nov. 21, 2001

(86) PCT No.: PCT/DE01/04431

§ 371 (c)(1),
(2), (4) Date: Dec. 2, 2003

(87) PCT Pub. No.: WO02/098253

PCT Pub. Date: Dec. 12, 2002

(65) Prior Publication Data

US 2004/0148806 A1 Aug. 5, 2004

(30) Foreign Application Priority Data

Jun. 4, 2001 (DE) ..... 201 09 166 U

(51) Int. Cl.
*A43C 15/08* (2006.01)
*A43C 15/00* (2006.01)
*A43B 13/22* (2006.01)

(52) U.S. Cl. ..... 36/59 C; 36/67 A; 36/59 A

(58) Field of Classification Search ..... 36/59 C, 36/67 R, 67 A, 59 A, 59 D, 134
See application file for complete search history.

(56) References Cited

U.S. PATENT DOCUMENTS

| | | | | |
|---|---|---|---|---|
| 3,918,181 | A * | 11/1975 | Inohara | 36/59 C |
| 3,988,840 | A | 11/1976 | Minihane | |
| 4,060,917 | A * | 12/1977 | Canale | 36/59 C |
| 4,085,527 | A * | 4/1978 | Riggs | 36/59 C |
| 4,327,503 | A * | 5/1982 | Johnson | 36/59 C |
| 4,364,190 | A * | 12/1982 | Yonkers | 36/59 C |
| 4,372,058 | A * | 2/1983 | Stubblefield | 36/59 C |
| 4,402,145 | A | 9/1983 | Dassler | |
| 4,670,997 | A * | 6/1987 | Beekman | 36/59 C |
| 4,885,851 | A * | 12/1989 | Peterson | 36/67 A |
| 5,533,282 | A * | 7/1996 | Kataoka et al. | 36/67 R |
| 6,338,208 | B1 * | 1/2002 | Waterbury | 36/134 |
| 2003/0029060 | A1 * | 2/2003 | Hockerson et al. | 36/67 R |

FOREIGN PATENT DOCUMENTS

| | | |
|---|---|---|
| DE | 24 54 241 A1 | 5/1976 |
| DE | G 83 00 168.9 U1 | 11/1983 |
| DE | 37 03 932 A1 | 8/1988 |
| DE | 44 17 563 A1 | 11/1995 |
| WO | WO 01/72161 A1 | 10/2001 |

* cited by examiner

*Primary Examiner*—Anthony Stashick
(74) *Attorney, Agent, or Firm*—Nixon Peabody LLP; David S. Safran

(57) ABSTRACT

An outsole (1) for athletic shoes (2) having stud-type cleat elements arranged in the front sole area (3) and heel area (4), the cleat elements extending in a conically tapered manner from the base (6) thereof to the contact surface (7). To improve the outsole, in order to enable improved contact of the feet when they are placed on the ground, even when the ground is moderately hard, the height ($h_{red}$) of at least one cleat element (5') in the sole edge area (12) of the heel area (4) is reduced in relation to the average height ($h_{norm}$) of the other cleat elements (5") in that area.

15 Claims, 3 Drawing Sheets

OUTSOLE FOR SPORTS SHOES

BACKGROUND OF THE INVENTION

1. Field of the Invention

This application is a 371 of PCT/DE01/04431 Filed Nov. 21, 2001.

The invention relates to an outsole for athletic shoes, in particular football shoes, with cleats tapering conically from their base to their contact surface and molded onto the front sole region and heel region of the sole.

2. Description of Related Art

An outsole of the kind described is known from published German Patent Application DE 37 03 932 A1. Here, cleats which protrude normally from the base geometry of the sole are molded to the sole by a common injection molding process through which the sole is also manufactured. With such cleats the result is a athletic shoe which exhibits good gripping properties, particularly on hard ground.

A athletic shoe is known from German Patent Application DE 24 54 241 A which exhibits so-called sliding prevention profiling in the heel region. For this, provision is made for the portion of the sole of the shoe which curves upwards around the heel to be provided with sliding prevention studs which are reduced in height in relation to the height of the sole cleats. The result of this is that the shoe has a better grip in the ground when the wearer of the shoe wishes or has to take an extended stride at full stretch.

U.S. Pat. No. 3,988,840 discloses a sole for a athletic shoe which is supposed to stand out through particularly good traction on the ground. Here, provision is made for the sole edge region—extending around the entire circumference of the sole—to be provided with cleats, all of which are reduced in height relative to the cleats located in the "inner region" of the sole.

A athletic shoe is known from U.S. Pat. No. 4,327,503 the sole of which is provided with studs. Here, provision is made for the use of both cleats with a greater height and cleats with a reduced height.

Here, it has proved to be disadvantageous that above all with moderately hard ground, for example superficially frozen ground, contact between the foot and the ground is undesirably hard. In addition, with such ground stability is reduced since a "stilt effect" is produced in that the surface supporting the foot lies at least the height of the cleats above the ground.

Therefore, the underlying object of the invention is to develop a athletic shoe of the kind known previously such that the foot slides in better on contact with the ground even with moderately hard ground. In addition, the "stilt effect" is to be reduced so that more stable contact between the foot and the ground is possible.

SUMMARY OF THE INVENTION

A primary object of the invention is achieved by the height of at least one cleat in the sole edge region of the heel region being reduced as compared to the average height of the other cleats in this region, all the cleats in this region lying in an angular range of 30° to 135°, preferably 60° to 120° of an imaginary circle defining the end region of the heel region, being reduced in height and the cleats reduced in height facing the ground when the athletic shoe is standing on the ground.

As a result, in particular the shoe slides in better on the ground; in addition, the "stilt effect" is reduced.

Here, advantageously, the cleats which are reduced in height exhibit a maximum of 60%, preferably a maximum of 30% of the average height of the cleats which are not reduced in height. The base of the molded cleats can have an elongated cross-section, in particular a cross-section similar to the shape of an ellipse.

The following advantages are obtained with the proposed design of the outsole of a athletic shoe—in particular when used on moderately hard ground:

When the foot makes contact with the ground, the heel region of the shoe slides in better on the ground.

The "stilt effect" is reduced, resulting in improved stability.

Contact with the ground can be controlled better.

Unnatural or harmful levers, specifically when the shoe comes into contact with the ground, are avoided by the cleats which are reduced in height so that the foot can roll on the ground better without stability being reduced. This allows more natural rolling of the foot on the ground.

Sliding contact is possible so that the foot is exposed to reduced loading.

An embodiment example of the invention is illustrated in the drawing and is described in detail below.

DETAILED DESCRIPTION OF THE INVENTION

Figure 1:
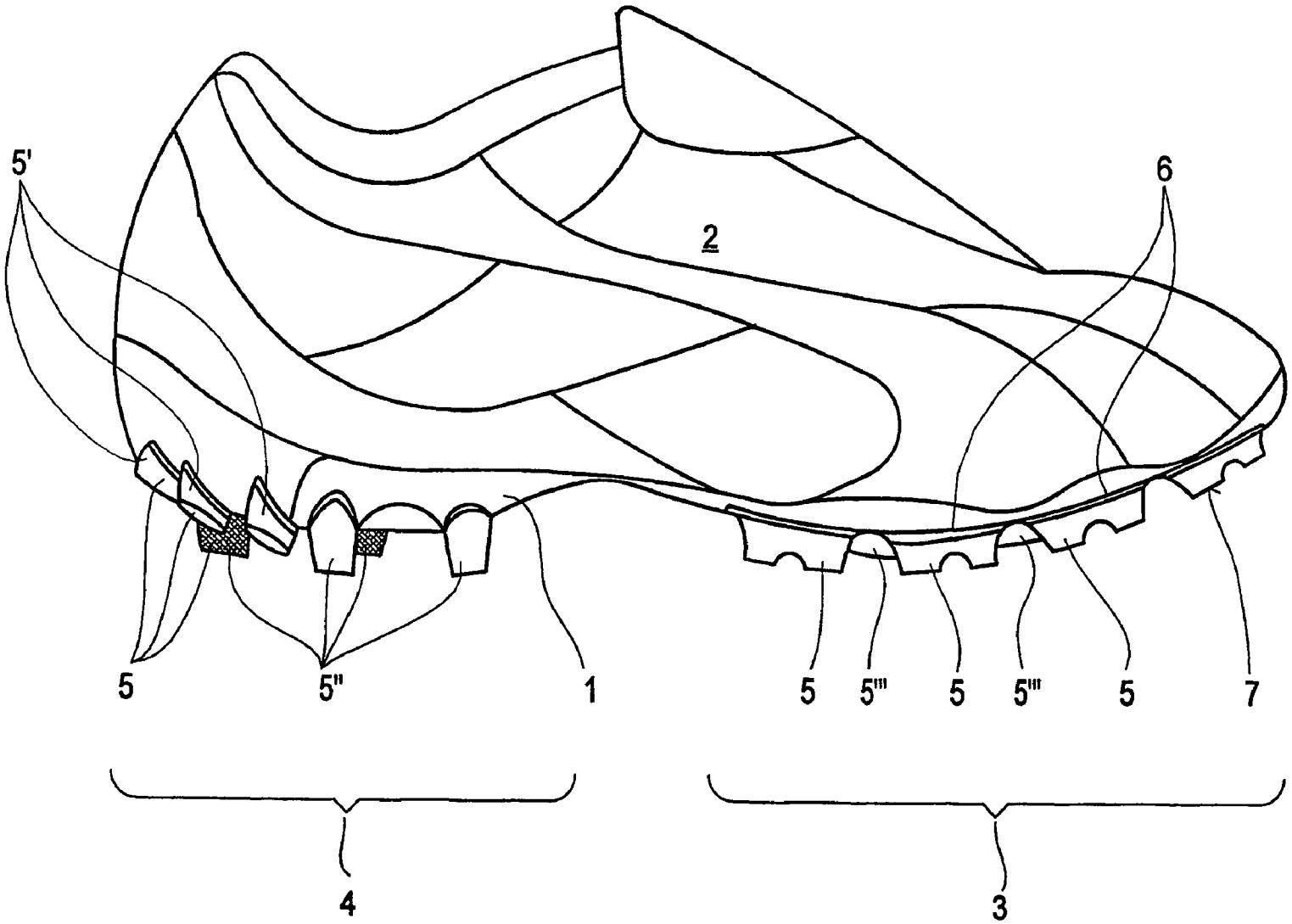
FIG. 1 is a diagrammatic side view of a athletic shoe.

FIG. 1 shows a left athletic shoe 2 that has an outsole 1 on the underside of which are arranged a plurality of cleats 5, 5', 5", 5'". The cleats 5 to 5'" are injection molded in a common injection molding process when the outside 1 is injection molded, i.e., are molded onto the outsole 1.

The cleats 5, 5', 5", 5'" or a part thereof are arranged both in the front sole region 3 and in the heel region 4 of the outsole 1. These cleats have a base 6 from which they taper conically to their contact surface 7.

Figure 3:
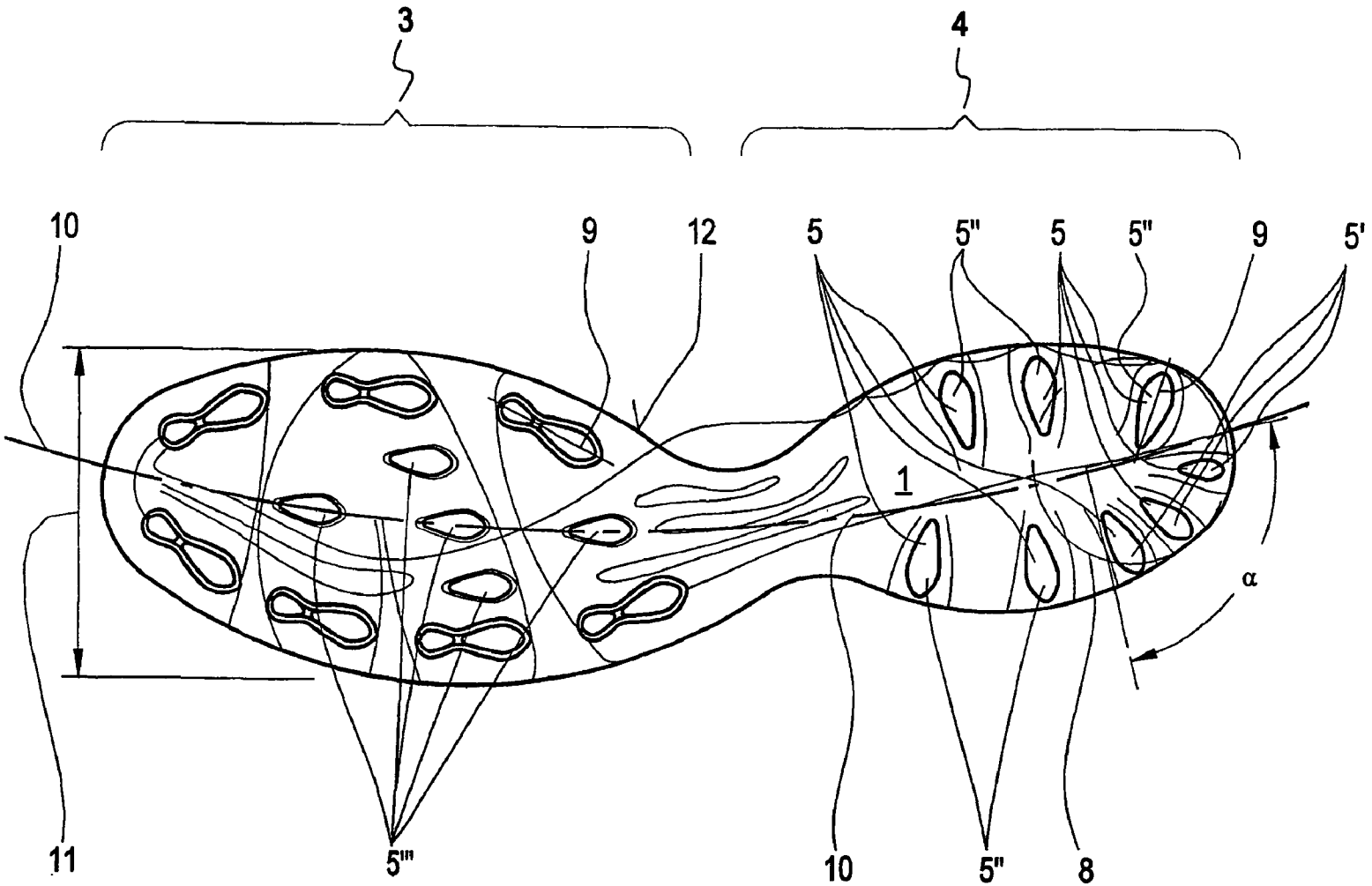
FIG. 3 is a bottom plan view of the outsole.

In cross-section, the cleats 5, 5', 5", 5'", like the base 6, have an elongated shape, preferably an elliptical or roughly elliptical shape, as can be seen in FIG. 3. In the front sole region 3, cleats 5 are arranged along the sole edge region 12, the longitudinal axis 9 of which runs in the direction of the sole edge region 12. In contrast, in the heel region 4, the cleats 5 are arranged in the sole edge region 12 so that the longitudinal axis 9 of the cleats runs at least roughly transversely to the direction of the sole edge region 12.

The outsole 1, which overall exhibits a sole width 11, is also provided with inner cleats 5'" in the front sole region 3. These are surrounded by the cleats 5 in the sole edge region 12, and in the illustrated embodiment, are arranged so that their longitudinal axis 9 runs in the direction of the longitudinal axis 10 of the sole.

Figure 2:
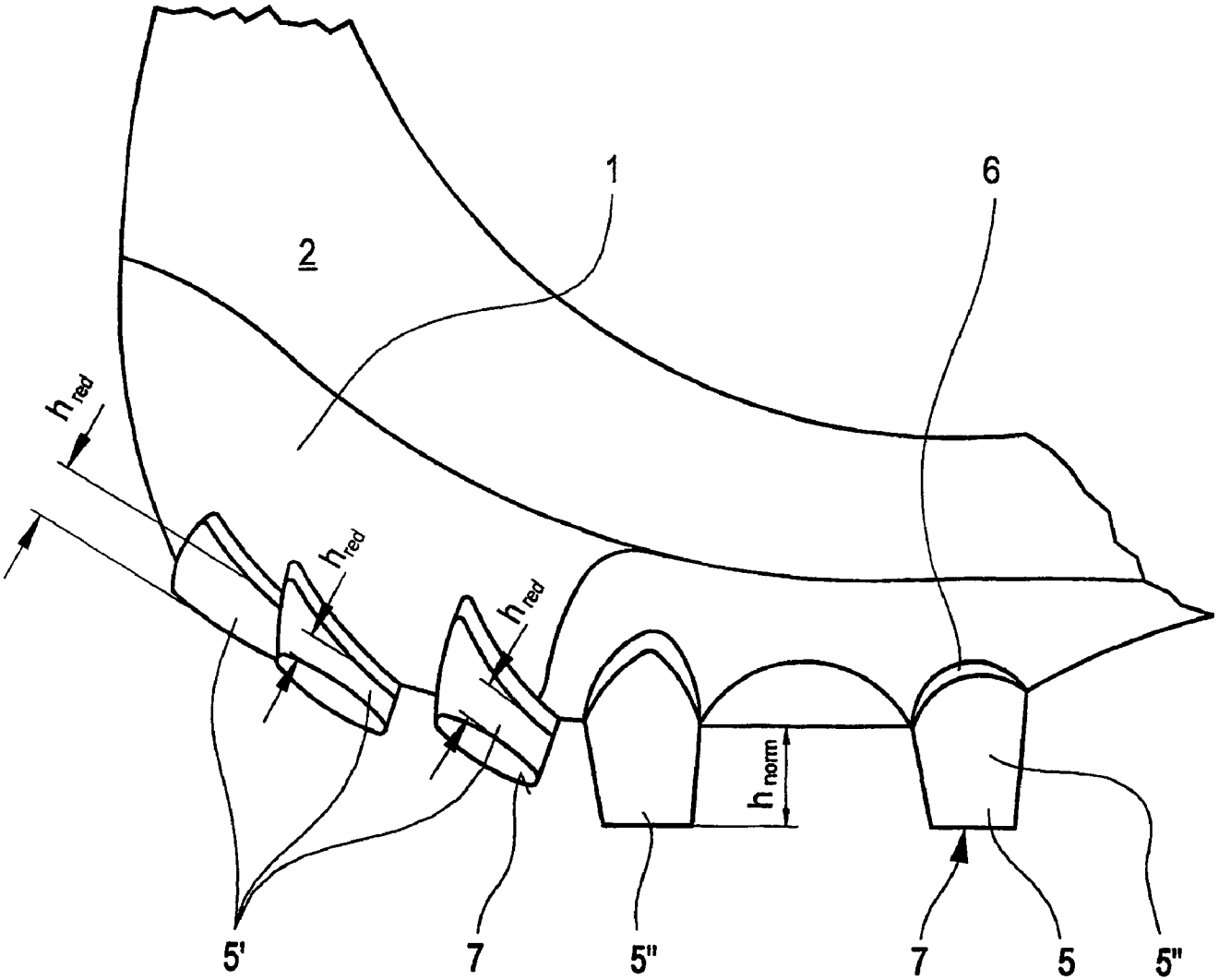
FIG. 2 is an enlarged detail of the side view of the heel region of this athletic shoe.

As can be seen best in FIG. 2, according to the invention, some cleats 5' in the sole edge region 12 of the heel region 4 have a reduced height $h_{red}$ compared with the average height $h_{norm}$ of the other cleats 5". In the illustrated embodiment, three cleats 5' are reduced in their height.

If a bounding circle 8 is defined for the end region of the heel region 4 (see FIG. 3), it can be said that all of the cleats 5' inside of an arc range $\alpha$, which preferably lies between 60° and 120°, are reduced in height.

Here, the height of the cleats 5' is reduced so that they only exhibit a maximum of 30% of the height exhibited on average by the remaining cleats 5" of normal height.

Also, the height of the cleats 5 in the sole edge region 12 of the front sole region 3 is less than the height of the cleats 5" that are not of a reduced height in the sole edge region 12 of the heel region 4.

The inner cleats 5'" in the front sole region 3 have a height which is less than the height of the cleats 5 that are not of a reduced height in the sole edge region 12.

The proposed design ensures that the contact properties of an athletic shoe, in particular, a football (soccer) shoe, are improved specifically on moderately hard ground.

The invention claimed is:

1. Outsole for athletic shoes with stud-shaped cleats that taper conically from a base to a contact surface thereof and are molded onto a front sole region and a heel region of the outsole, wherein all cleats in a sole edge region along the left and right sides of the front sole region are of substantially the same height and all cleats in a sole edge region along the left and right sides of the heel sole region are of substantially the same height except for at least one cleat in the heel region which has a height that is reduced as compared to an average height of other cleats in the heel region, and wherein the at least one cleat of reduced height lies in a portion of the heel sole region which extends in an angle range relative to a longitudinal centerline of the outsole of 30° to 135° of an imaginary circle defining an end area of the heel sole region and faces the ground when the sole stands on the ground.

2. Outsole according to claim 1, wherein said angle range is 60° to 120°.

3. Outsole according to claim 1, wherein the cleats which are reduced in height have a height which is a maximum of 60% of the average height ($h_{norm}$) of the cleats which are not reduced in height.

4. Outsole according to claim 1, wherein the cleats which are reduced in height have a height which is a maximum of 30% of the average height ($h_{norm}$) of the cleats which are not reduced in height.

5. Outsole according to claim 1, wherein the base of the cleats have an elongated cross-section.

6. Outsole according to claim 5, wherein the elongated cross-section is of a generally elliptical shape.

7. Outsole according to claim 1, wherein a longitudinal axis of the cleats in the front sole region runs in toward an edge of the sole.

8. Outsole according to claim 7, wherein a longitudinal axis of the cleats in the heel region runs transversely to the edge of sole.

9. Outsole according to claim 1, wherein a longitudinal axis of the cleats in the heel region runs transversely to an edge of sole.

10. Outsole according to claim 1, wherein the cleats of the front sole region comprise inner cleats surrounded by cleats in a sole edge area, and wherein a longitudinal axis of the base of at least one of the inner cleats runs in the direction of a longitudinal axis of the sole.

11. Outsole according to claim 10, wherein the cleats in the sole edge area of the front sole region have a height that is less than the height of the cleats which are not reduced in height in the sole edge region of the heel region.

12. Outsole according to claim 1, wherein the cleats of the front sole region comprise inner cleats surrounded by cleats in a sole edge area, and wherein the inner cleats have a height which is less than the height of the cleats in the sole edge area.

13. Outsole according to claim 12, wherein in a middle part of the front sole region at least three cleats are arranged in a row across the width of the sole.

14. Outsole according to claim 13, wherein the cleats in said row are offset relative to each other in the direction of a longitudinal axis of the sole.

15. Outsole according to claim 1, wherein the cleats have a ground contact surface which runs from the sole edge toward a longitudinal axis of the sole with a decreasing height.

* * * * *